US006378869B1

(12) United States Patent
Hedge, Jr. et al.

(10) Patent No.: US 6,378,869 B1
(45) Date of Patent: Apr. 30, 2002

(54) CASINO STYLE GAME PLAYED WITH THREE DICE

(76) Inventors: J. Richard Hedge, Jr.; Aviva R. Hedge, both of 7839 E. Nestling Way, Scottsdale, AZ (US) 85255

( * ) Notice: Subject to any disclaimer, the term of this patent is extended or adjusted under 35 U.S.C. 154(b) by 0 days.

(21) Appl. No.: 09/494,687

(22) Filed: Jan. 31, 2000

(51) Int. Cl.[7] ..... A63F 3/00
(52) U.S. Cl. ..... 273/274; 273/146
(58) Field of Search ..... 273/274, 146, 273/292; 463/22

(56) References Cited

U.S. PATENT DOCUMENTS 4,247,114 A * 1/1981 Carroll
4,334,685 A * 6/1982 Robbins et al.
5,308,081 A * 5/1994 Bartle
5,573,248 A * 11/1996 Parra et al.
5,791,651 A * 9/1998 Bryant
5,931,471 A * 8/1999 Bonito
6,209,874 B1 * 4/2001 Jones

OTHER PUBLICATIONS 01, 1961, Scarne, Scarne on Dice pp. 341–345.

* cited by examiner

*Primary Examiner*—William M. Pierce

(57) ABSTRACT

A process for playing a casino style game using three six-sided dice, being rolled at separate times through the course of completing each hand. In action, this splitting of a hand's roll, first rolling two-dice, then rolling a third-single die, establishes a unique consequences for not only the applicants' game but, also his industry of casino gaming. Furthermore, a hand begins with the first rolling of a pair of dice baring an outcome possibility of two through twelve. In example, say the first roll is a two-dice roll of seven (20) having a first predetermined payoff (21) showing above such a first winning field number. Moreover, immediately after establishing a first winning number the third-single, and final die, is rolled for its outcome of a one through six respectively. Upon its showing, of say a one, it's outcome is then added to the first two-dice roll sum, of seven (20), to produce the second winning field number in this instance, an eight, having its predetermined payoff (23) located beneath such a second winning field number, whatever the final outcome. Additionally, there remains the various ancillary wagers (50) located about the games layout. And, as such, these wagers include any type and value of wagers capable of being associated with this split hand method of play for three-dice. Also, at hand is the ameliorating action of the ace-deuce three (48) insurance wager for reducing either the player's or casino's exposure to extended loss.

15 Claims, 10 Drawing Sheets

*Fig. 2*

*1 way* to roll: *2/* 1-1

*2 ways* to roll: *3/* 1-2, 2-1

*3 ways* to roll: *4/* 1-3, 3-1, 2-2

*4 ways* to roll: *5/* 1-4, 4-1, 2-3, 3-2

*5 ways* to roll: *6/* 1-5, 5-1, 2-4, 4-2, 3-3

*6 ways* to roll: *7/* 1-6, 6-1, 2-5, 5-2, 3-4, 4-3

*5 ways* to roll: *8/* 2-6, 6-2, 3-5, 5-3, 4-4

*4 ways* to roll: *9/* 3-6, 6-3, 4-5, 5-4

*3 ways* to roll: *10/* 4-6, 6-4, 5-5

*2 ways* to roll: *11/* 5-6, 6-5

*1 way* to roll: *12/* 6-6

With two-dice there are: *36 ways* to roll a 2 ~ 12

*Fig. 5*

*3/* 1-1-1

*4/* 1-1-2;
1-2-1; 2-1-1

*5/* 1-1-3; 1-3-1; 3-1-1;
1-2-2; 2-1-2; 2-2-1

*6/* 1-1-4; 1-4-1; 4-1-1; 1-2-3;
2-1-3; 3-2-1; 2-3-1; 3-1-2; 1-3-2; 2-2-2

*7/* 1-1-5; 1-5-1; 5-1-1; 1-3-3; 3-1-3; 3-3-1; 3-2-2;
2-3-2; 2-2-3; 1-2-4; 2-1-4; 4-2-1; 4-1-2; 2-4-1; 4-2-1

*8/* 1-1-6; 1-6-1; 6-1-1; 1-2-5; 2-1-5; 5-1-2; 1-5-2; 5-2-1; 2-5-1; 1-3-4;
3-1-4; 4-1-3; 1-4-3; 4-3-1; 3-4-1; 2-2-4; 2-4-2; 4-2-2; 3-3-2; 3-2-3; 2-3-3

*9/* 1-2-6; 2-1-6; 2-6-1; 6-2-1; 1-6-2; 6-1-2; 1-3-5; 3-1-5; 3-5-1; 5-3-1; 1-5-3; 5-1-3;
4-4-1; 4-1-4; 1-4-4; 2-3-4; 3-2-4; 3-4-2; 4-3-2; 2-4-3; 4-2-3; 2-2-5; 2-5-2; 5-2-2; 3-3-3

*10/* 1-3-6; 3-1-6; 3-6-1; 6-3-1; 1-6-3; 6-1-3; 1-4-5; 4-1-5; 1-5-4; 5-1-4; 4-5-1; 5-4-1; 3-4-3;
4-3-3; 3-3-4; 2-2-6; 2-6-2; 6-2-2; 2-3-5; 3-2-5; 2-5-3; 5-2-3; 3-5-2; 5-3-2; 2-4-4; 4-2-4; 4-4-2

*11/* 1-4-6; 4-1-6; 1-6-4; 6-1-4; 4-6-1; 6-4-1; 1-5-5; 5-1-5; 5-5-1; 2-3-6; 3-2-6; 2-6-3; 6-2-3; 3-6-2;
6-3-2; 3-3-5; 3-5-3; 5-3-3; 3-4-4; 3-4-3; 4-4-3; 2-4-5; 4-2-5; 2-5-4; 5-2-4; 4-5-2; 5-4-2

*12/* 1-5-6; 5-1-6; 1-6-5; 6-1-5; 5-6-1; 6-5-1; 2-4-6; 4-2-6; 2-6-4; 6-2-4; 4-6-2; 6-4-2; 2-5-5;
5-2-5; 5-5-2; 3-3-6; 3-6-3; 6-3-3; 3-4-5; 4-3-5; 3-5-4; 5-3-4; 4-5-3; 5-4-3; 4-4-4

*13/* 1-6-6; 6-1-6; 6-6-1; 2-5-6; 5-2-6; 2-6-5; 6-2-5; 5-6-2; 6-5-2; 3-4-6; 4-3-6;
3-6-4; 6-3-4; 4-6-3; 6-4-3; 4-4-5; 4-5-4; 5-4-4; 3-5-5; 5-3-5; 5-5-3

*14/* 2-6-6; 6-2-6; 6-6-2; 3-5-6; 5-3-6; 3-6-5; 6-3-5; 5-6-3;
6-5-3; 4-4-6; 4-6-4; 6-4-4; 4-5-5; 5-4-5; 5-5-4

*15/* 3-6-6; 6-3-6; 6-6-3; 4-5-6; 5-4-6; 4-6-5;
6-4-5; 5-6-4; 6-5-4; 5-5-5

*16/* 4-6-6; 6-4-6; 6-6-4;
5-5-6; 5-6-5; 6-5-5

*17/* 5-6-6; 6-5-6;
6-6-5

*18/* 6-6-6

With three-dice there are: *216 Ways* to roll a 3 ~ 18

CASINO STYLE GAME PLAYED WITH THREE DICE

FIELD OF INVENTION

This invention relates to games of chance as historically identified with Casinos.

The applicants' methods are inclusive to a variety of live action table gaming formats, as well as electronic display applications of all types. Their inventive process engages the instrument of dice, the six-sided type to be specific. Also, the present invention utilizes a process formulated upon the use of three (3) dice being rolled at separate times through the course of each hand.

In action, this splitting of a hand's roll, first rolling two (2) dice, then rolling a third single die, bares unique consequences to the applicants' applied industry of casino gaming. Moreover, a quick simplistic method of "dice play" is provided for player(s) looking for a fun, entertaining time, wherein a reasonable chance of winning may be had.

DESCRIPTION OF PRIOR ART

Presently, the applicants' know of no game, either of the "Parlor" variety or any other form of "live action/video games," including those banked by a house (casino) being managed with or without dealers that are presently under Patent enforcement or otherwise which might be construed as teaching on or reading upon their concepts and process of play.

Therefore, Public Domain games are most appropriately discussed here.

In the arena of the Public Domain, two games, Bank Craps and English Hazard, come to mind. Both games have their instruments (dice) and therefore, their root origins (process of play) originally associated together. This is not only because they are games played with dice but, more importantly because, once-upon-a-time there were two varieties of English Hazard. There was two-dice Hazard and three-dice Hazard. Two-dice Hazard ultimately became Bank Craps while three-dice Hazard ultimately became Grand Hazard or just plain Hazard.

In recent centuries, most dice games have evolved to utilize six-sided dice for their consequence of play. This is well known on the one hand regarding Bank Craps (Craps), wherein a matched-pair is used for play. On the other hand, Grand Hazard (Hazard) uses a set of three (3) six-sided dice.

Given that Craps is multifaceted in its play, and historically the grand daddy of dice games, a basic understanding of the core methodology of Pass line play, along with a compatible understanding of the core process for playing Hazard is forthcoming and primary to the arrival of the applicants' inventive process, as described and illustrated further below.

Nevertheless, casino games, be they old or new, must maintain the public's continuing participation in significant enough numbers as to support their value (hold %) in each casino. In this way, the housemasters (casino management) who are the sponsors of all forms of gaming, including their environmental surroundings, can justify their useful existence.

Also, in the gaining business, there is one particularly important issue that is held foremost in the minds of housemasters. This issue is a concept known as "Time-In-Play". In the casino business, the house's intentions are to part their customers from as much of their money as possible, but not so fast as to leave them feeling fleeced or ripped-off. Hence, even though a game's odds must necessarily favor the casino, the lower the house's percentage edge (vigorish or vig. as it is known in the business), the better the opportunity for continuing the public's patronage, whereby the game can ultimately become a profitable asset for housemasters.

Of course, this is notwithstanding a customer doing something really stupid.

As for the game of Craps, there are 36 possible outcomes on a pair of "fair dice" with the "seven" being the most likely number to show. When playing the Pass line, the front and center core of the game, a player is wagering that a Point number (i.e., 4, 5, 6, 8, 9 or 10) will be established (thrown) and then repeated again before a "seven" shows, no matter how many no consequence rolls it takes. If the number is repeated (thrown) again before a "seven" shows, the hand is won.

Should the "seven" show first before the established "Point" number does, the hand is lost. These are the fundamentals for Pass line play in the game of Craps. In action, Craps is often very difficult to follow and therefore hard to understand. However, the "vig." (the house's percentage edge against the player) appears tolerable on the Pass line, at −1.4%, to most that attempt its play. Additionally, Craps offers a number of aincillary wagers available to players but, they too are of little value in comparison to the core process of play relating to the applicants' game.

The game of Hazard, on the other hand, is quite simple to understand because all wagering opportunities across the board are do or die upon each roll of the dice. That is, all three dice being rolled at once.

Moreover, Hazard, by virtue of being a three (3) dice game, has 216 possible outcomes to be factored from 3~18. As such, Hazard has as its main consequence of play, a Field number selection of 4~17. For the purpose of expression, think of it like this, the 3/4-5-6-7-8-9-11-12-13-14-15-16-17/18 as viewed in the shape of a bowl.

So, as one sees this in play, the 10 & 11 are at the bottom center of the bowl, being that these two numbers are equally the most likely to show (27 ways each) and, therefore payoff the least amount of money (6 for 1) when they do show. Likewise, as we look up the sides of this bowl, we see each congruent number set (i.e., 10 & 11; 9 & 12; 8 & 13 etc.), all the way up to and including the 4 & 17, which pays the most at (60 for 1). Therefore, because these number(s) are less and less likely to show, these number(s) pay more when they do show. But, to the significant detriment of the game, Hazard maintains a very heavy vigorish (house edge) over the player through its Field number wagers at −16⅔% to −30⅚%.

TABLE 1

| One Roll No.'s | Payoffs | Vigorish |
|---|---|---|
| | Ancillary Wagers: | |
| 3 & 18 | 180 for 1 | −16 ⅔% |
| | Field Wagers: | |
| 4 & 17 | 60 for 1 | −16 ⅔% |
| 5 & 16 | 30 for 1 | −16 ⅔% |
| 6 & 15 | 18 for 1 | −16 ⅔% |
| 7 & 14 | 12 for 1 | −16 ⅔% |
| 8 & 13 | 8 for 1 | −22 ⅙% |
| 9 & 12 | 6 for 1 | −30 ⅚% |
| 10 & 11 | 6 for 1 | −25.00% |

Since Hazard's heavy vigs. are a fixed mathematical result of three-dice being rolled all at one time, wherein a single event's outcome represents the beginning and end of a hand, it is really no wonder that Hazard's 500 plus year history has faded.

Furthermore, as in Craps, Hazard has numerous ancillary wagers that play along with the established main Field number selection 4~17. These ancillary wagers include even money payoffs like the High-/Low & Odd/Even number groups as well as long shots wagers like Three-of-a-Kind, Aces (3), Deuces (6), Trays (9), Squares (12), Flowers (15), and Boxcars (18). Although, they too are one roll wagers. Moreover, such ancillary wagers still offer little useful assistance in understanding the core process of play regarding the applicants' game as claimed.

Consequently, in years gone by, players have said about Hazard, "All you need are a few get lucky wins to get started" to give you a real chance of "hit'em big". Of course, assuming you as a player have deep enough pockets to weather the loses in search of that "big" hit.

Craps to the contrary, is a very difficult game to grasp especially in its casino environment, which has always been a driving reality feeding its waning status of more recent years, even in view of its perceived lower vigorish working against its players.

SUMMARY

Although from the applicants' perspective, there is an alternative, the applicants' three (3) dice game ascends aside of such examples. That is, would-be dice players would no longer have only the option of playing a complicated game like Craps or a heavy vig. game like Hazard.

First, unlike Craps, the applicants' game is simple, requiring only passive mental engagement on the part of its players. Second, unlike Hazard, the applicants' three-dice game exacts a significantly lower working percentage against its player(s), in that the applicants' balanced methodology deploys a never before taught synergy of ameliorating consequences.

As such, these consequences are directly related to the applicants' establishment of a "split" two-roll-event hand of play, the effects of which purposely impact upon the workable mathematics of a three-dice outcome dynamic.

OBJECTS AND ADVANTAGES

Accordingly, several objects and advantages of the applicants' three-dice game are the method of splitting a hand into two (2) separate events, first rolling two-dice, then rolling a third single die, rather than rolling all-three-dice together for a single do or die event. The former methodology of three-dice play clearly recognizes and resolves the long established problem of an inherently strong vigorish that has traditionally been associated with three-dice games. This is particularly the case regarding Hazard's core sets of Field number play(s) 4~17.

Moreover, the applicants' game by de facto of being a three-dice game, plays through a total range of numbers 3~18 just as its Hazard origins do. But, wholly unlike Hazard or any other dice game known to the applicants, the applicants' applied technique in splitting a hand's play into two (2) separate but coalescing rolls of the dice establishes a circumstance of which there results not only a significantly reduced vigorish at work, but also a very unique two-tier pay schedule as well.

Likewise, the applicants' methodologies establish the additional outcomes of Aces (2) and Ace-Deuce (3), respectively, for the first two-dice event of a hand. Therefore, this splitting of a hand's rolls into separate but coalescing events then results in the factoring of three additional outcomes (219 instead of 216), whereby adding to the mathematical dynamics of the applicants' three-dice gaming tactics.

Furthermore, it is the primary objective of the present methodology for dice play to provide a competitively low vigorish working through the applicants' game of core Field number(s) 4~17, therein establishing a new two-tier pay schedule.

It is another objective of the present methodology for dice play to provide a wholly new, wagering opportunity, wherein the player(s) can benefit from the impact of two (2) winning numbers occurring through each hand instead of just one (1).

It is still yet another objective of the present methodology for dice play to provide a unique adaptation in having up to five (5) surviving Field numbers as a core consequence of play, albeit, there is no mathematical necessity for such a play.

It is still yet another objective of the present methodology for dice play to provide a counter balancing, low impact wipe-out number that of an Ace and a Deuce (3) (i.e., 1-2; 2-1), being applied to affect the first two-dice event of a new hand.

It is still yet another objective of the present methodology for dice play to provide an additional assortment of ancillary wagers being offered for simultaneous action with the core methodology for Field play from which players can choose.

It is still yet another objective of the present methodology for dice play to provide an entirely new perspective of thought provoking play that competently coincides with accepted mathematical mechanics and procedures regarding the applied probabilities of chance.

Another consideration regarding the applicants' game lies in the nature and function of the fallout of losing numbers for which players endure through each hand, notwithstanding the showing of an ace-deuce (3) upon the first roll therein.

In play, the falling out of losing numbers works like this. After wagering, say the hand begins with a two-dice roll of nine (9). This means the Field numbers four (4), five (5), six (6), seven (7) & eight (8) lying sequentially before the nine (9) all fallout as wins for the house and losers for the player(s).

Followed quickly by the third die's roll of say a five (5), therein at once being added to the first winning roll of nine (9) to then total a second winning roll number for the hand of fourteen (14). This then leads to the falling out of the fifteen (15), sixteen (16) & seventeen (17) lying, this time, sequentially after the fourteen (14) as wins for the house and again as losers for the player(s), therein completing the hand.

In cooperation with this, there still remains the utilization of a low impact "wipe-out" roll, that of an ace-deuce (3), showing upon the first roll of a new hand. Herein, all Field number wagers along with most all other ancillary wagers being represented within the bounds of the applicants' gaming layout will fallout to the house as well. This is because the rolling of an ace-deuce (3) functions to offset a limited measure of the house's potential for over exposure and therefore, extended financial loss from splitting a hand's play into two distinct rolls.

Frankly, if the ameliorating effects of splitting a hand's play into two separate but coalescing rolls of the dice wasn't so successful in reducing the house's vigorish against players in the first place, therein allowing for surviving number (s) too, the utilization of a "wipe out" roll being applied through the rolling of an ace-deuce (3) upon the first roll event of a new hand would serve no particularly useful purpose.

Heretofore is a comparative example of the synergistic impact and effect of the applicants' method for splitting a hand into two coalescing rolls versus a single all-in-one roll, as historically associated with Hazard's process of play.

For example, two of Hazard's congruent number sets, 7 & 14; 9 & 12, exercise a −16⅔% and −30⅚% vigs. respectively, over the player(s). While within the applicants' three-dice game, the player(s) are not only exposed to a significantly lower accrued vigorish of a −2⅓% on the 7, −7⅜% on the 14, −5½% on the 9, and −2¾% on the 12 respectively.

But again, players will often experience a procession of surviving number(s) riding through each hand. A consequence for which player(s) are provided with the option of either moving surviving wager(s), removing surviving wager(s), or simply receiving another round of action for letting their wager(s) ride through for the outcome(s) of the next hand.

Immediately below is a likely predetermined payoff schedule for the applicants' Field numbers 4~17 wagers, as well as the basic ancillary wagers being discussed and shown along with their aggregate vigorish-percentages working against such wagers.

TABLE 2

| First-Tier Event | Payoff | Second-Tier Event | Payoff | Vigorish |
|---|---|---|---|---|
| | | Ancillary Wagers: | | |
| Two | 30 to 1 | | | −13.89% |
| Three 2/dice | 15 to 1 | | | −11.11% |
| | | Three 3/dice | 175 to 1 | −18.52% |
| | | Field Wagers: | | |
| Four | 9 to 1 | Four | 20 to 1 | −5.09% |
| Five | 5 to 1 | Five | 10 to 1 | −4.62% |
| Six | 3 to 1 | Six | 5 to 1 | −6.48% |
| Seven | 2 to 1 | Seven | 3 to 1 | −2.31% |
| Eight | 3 to 2 | Eight | 5 to 2 | −3.00% |
| Nine | 3 to 2 | Nine | 2 to 1 | −5.55% |
| Ten | 2 to 1 | Ten | 2 to 1 | −4.16% |
| Eleven | 2 to 1 | Eleven | 3 to 1 | −4.16% |
| Twelve | 9 to 1 | Twelve | 3 to 1 | −2.77% |
| | | Thirteen | 7 to 1 | −6.01% |
| | | Fourteen | 11 to 1 | −7.40% |
| | | Fifteen | 16 to 1 | −16.66% |
| | | Sixteen | 30 to 1 | −12.03% |
| | | Seventeen | 55 to 1 | −21.75% |
| Ancillary Wager: | | Eighteen | 175 to 1 | −18.52% |

Clearly in practice, and as further illustrated in the applicants' preferred embodiment, the first event rolling of two-dice together factors in one probability cast of outcomes, including the additional impact of an ameliorating "wipe-out," ace-deuce (3), application being factored within a first-tier schedule of payoffs, as well.

Next, a second event rolling of the third single die, begins with its own numeric outcome being found in a 1, 2, 3, 4, 5 or 6. This outcome is then added together with the first event's sum to establish a second winning number, having its own probability cast of outcomes incumbent within a second tier schedule of payoffs as described above.

To the knowledge of the applicants, none of these consequences have ever been played out in any previous dice game of record. Further objectives and advantages of the applicants' applied methodologies will become more apparent from a consideration of the drawings and ensuing description.

DESCRIPTION OF DRAWINGS

The foregoing features, advantages, and other objectives of the applicants' methodologies will become clearly understood from the following descriptions taken in conjunction with their accompanying illustrations and figure identifications.

FIG. 2 Illustrates a "Way" table showing the outcomes of two-dice being thrown and added together.

FIG. 5 Illustrates a "Way" table showing the outcomes of three-dice having been thrown and added together.

DETAILED DESCRIPTION OF THE DRAWINGS

Figure 1:
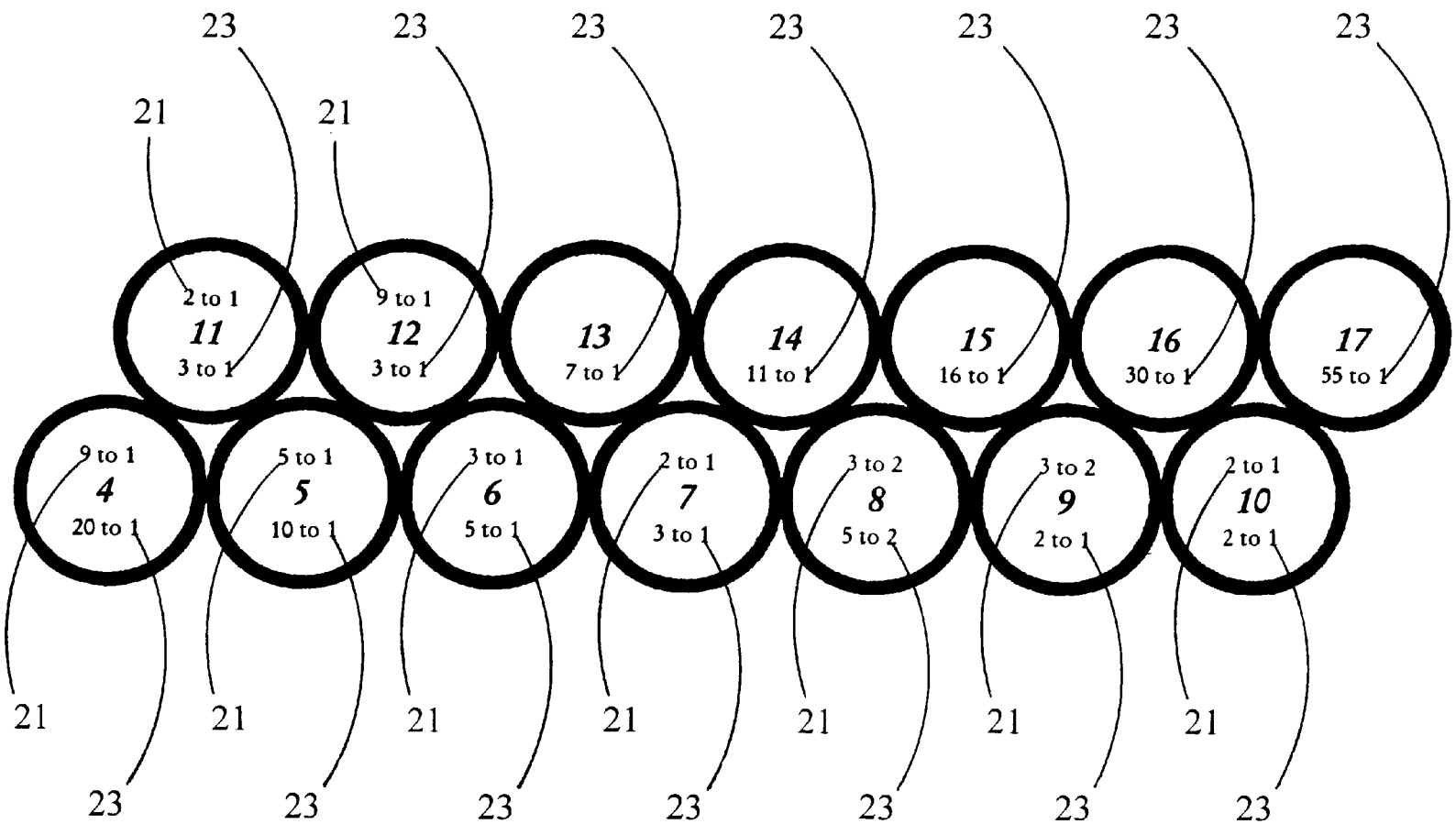
FIG. 1 Illustrates a plan view for the Field number wagering areas four (4) through seventeen (17), including sample payoff amounts.

In referring to the drawings as illustrated, it shall be understood that the combined entities of FIGS. 1 thru 9 inclusively are simply preferred embodiment of the applicants' gaming layout. As such, any and all of the wagering areas as shown are tacitly subject to change. This pertains to their physical shapes and reasonable associations to one another, including their material application to surfaces displaying such wagering options and all forms of electronic display.

Upon completion of a wagering cycle, the gaming process begins with the first of two dice events, by way of rolling a pair of dice. In example, the first pair's outcome shall total a four through twelve respectively. This is notwithstanding a roll of Aces/Two that is an ancillary wager lying outside of the field wagering area and, the Ace-Deuce/Three wager that is cited in FIG. 8 below. FIG. 1 illustrates both a first roll payoff valuations 21, lying above their respective number(s), and a third single die outcome payoff valuations 23, that are located underneath their respective number(s). FIG. 2 shows a two-dice "Way" table, wherein any one of thirty-six possible outcomes totaling two through twelve are illustrated.

Figure 3:
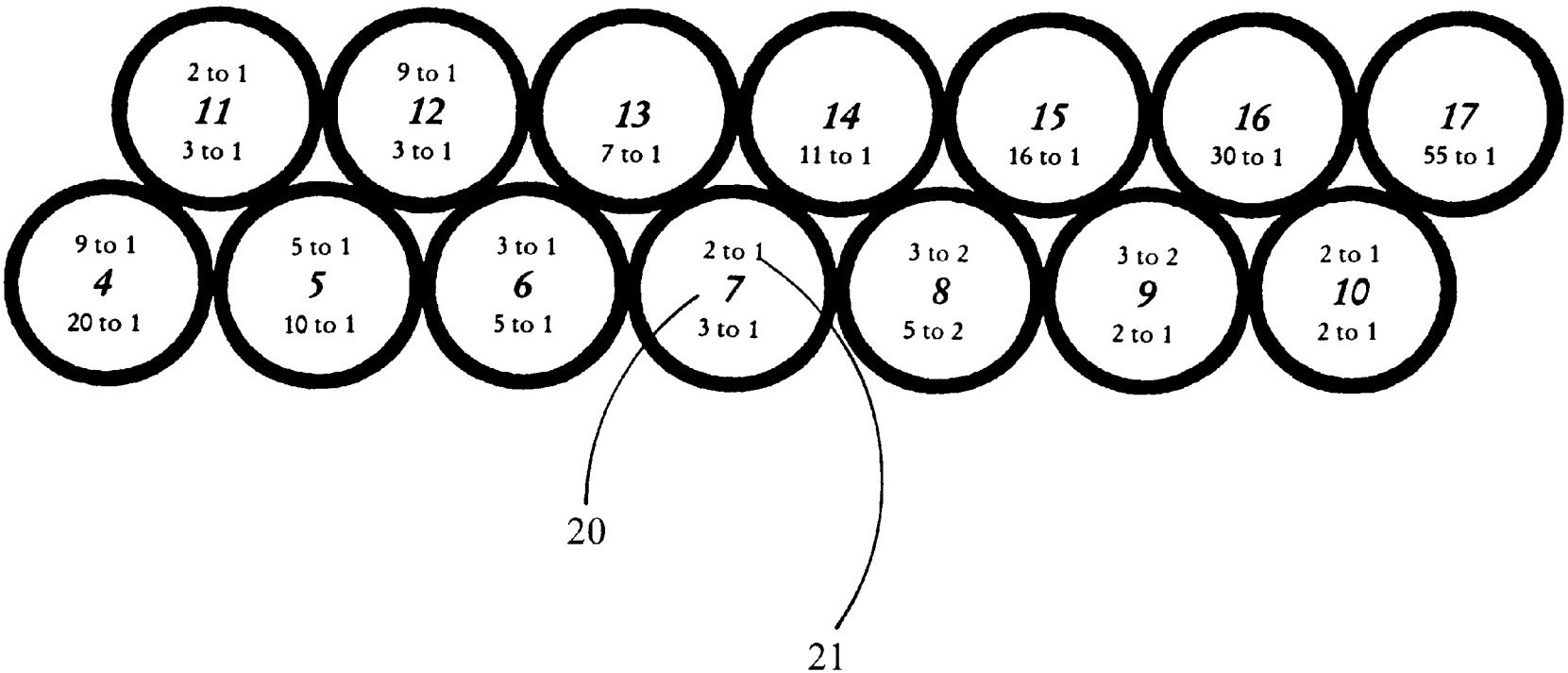
FIG. 3 Illustrates a plan view of the Field number wagering areas wherein a sampling of a first winning Field number Seven (7) has been rolled for the first two-dice event of a hand.
Figure 4:
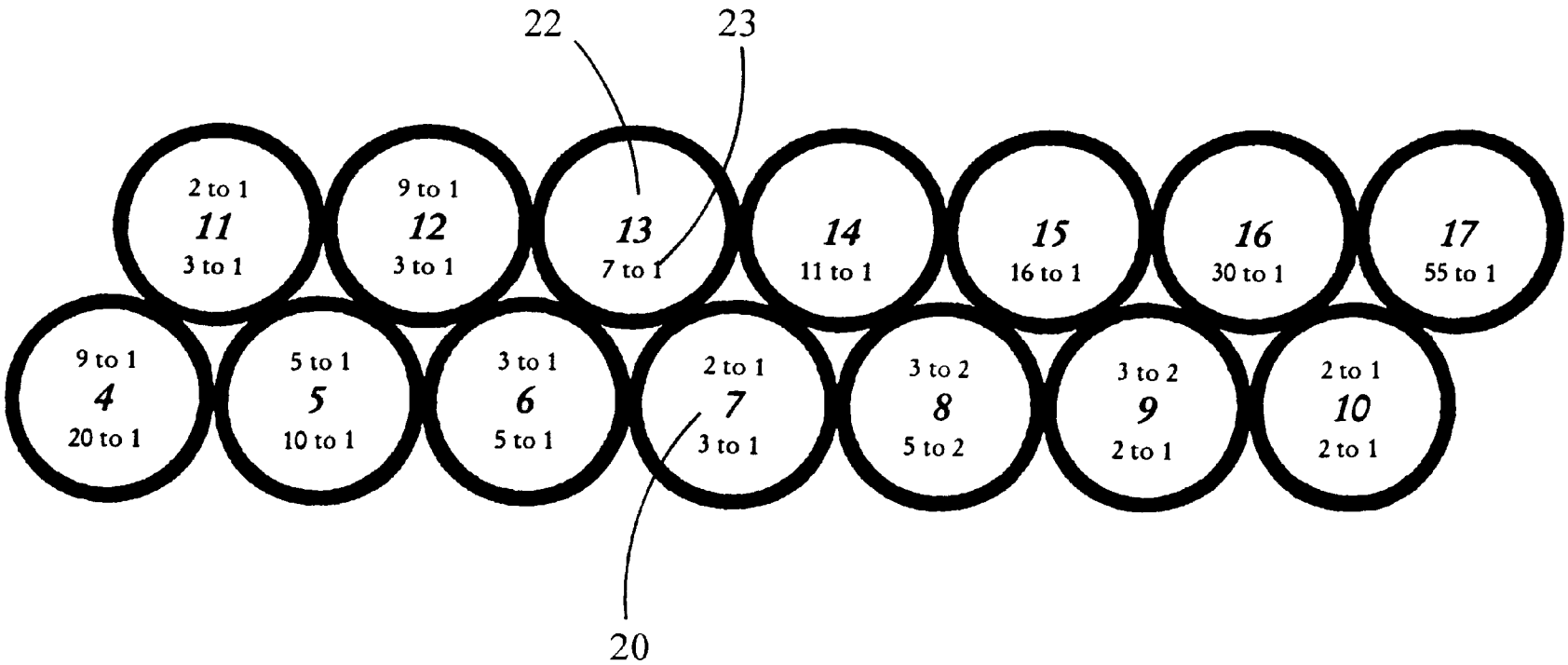
FIG. 4 Illustrates a plan view of the Field number wagering areas wherein a sampling of a second winning Field number Thirteen (13) has been established for the final third single die event of a hand.

In furthering this example of play, FIG. 3 illustrates a first winning outcome for the hand as rolling a seven 20, wherein the seven 20 is then paid off upon a predetermined first event payoff valuation 21, according to its likelihood of showing. The hand is then completed with the follow up roll of the third die's event. Here, the third die can only roll as a one, two, three, four, five or six.

Therefore, in this scenario's sampling, a single die six shows. Its outcome is then added to the sum of the first event's outcome of a two-dice seven 20, for a final three-dice sum and outcome of a thirteen 22 for the hand, as further illustrated in FIG. 4.

Likewise, the winning thirteen 22 is then paid off upon a predetermined second event payoff valuation 23, according to its likelihood of showing. Illustrated in FIG. 5 is a three-dice "Way" table, wherein any one of two-hundred-sixteen possible outcomes between three & eighteen can be totaled upon the dice.

Figure 6:
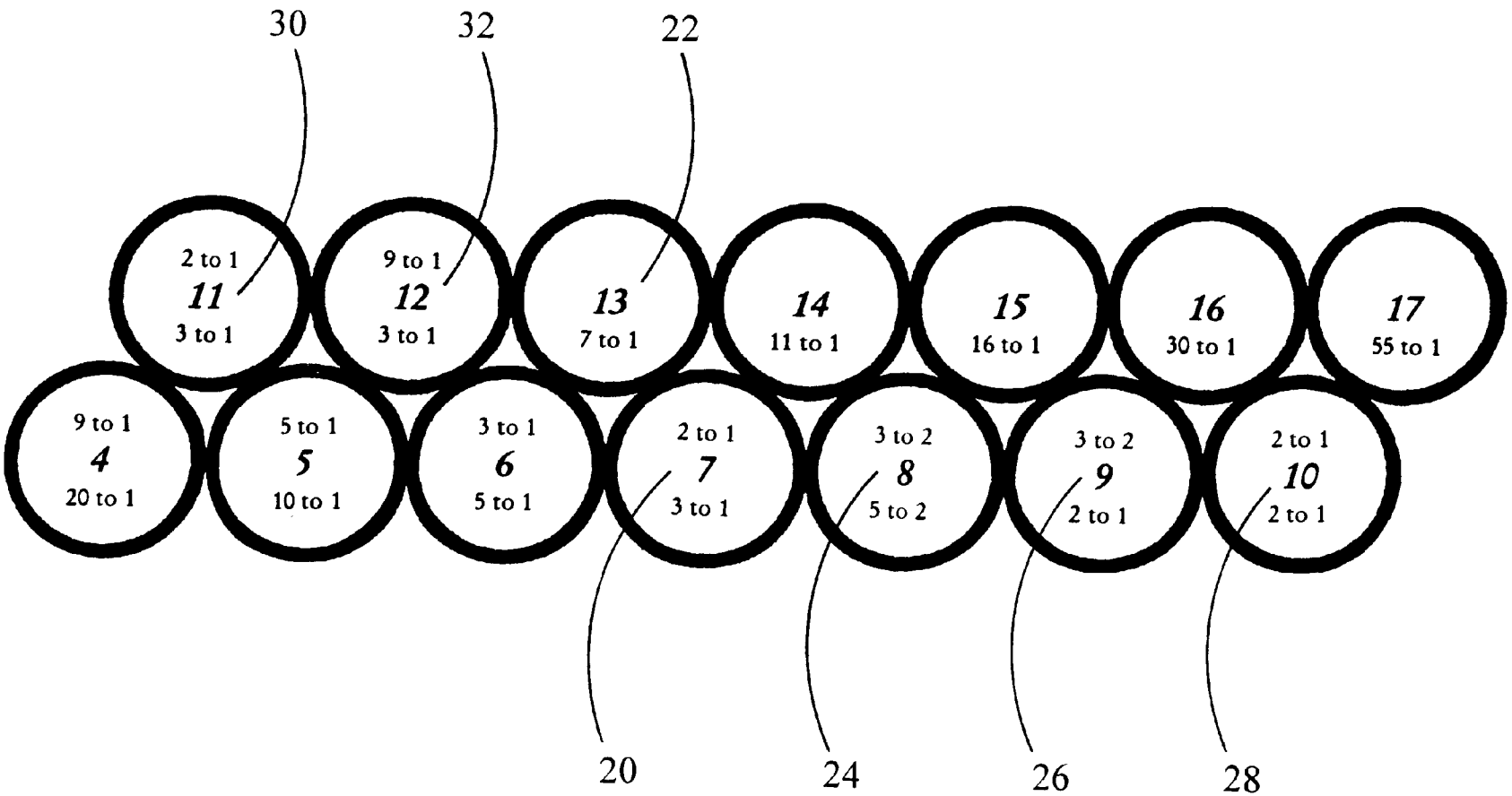
FIG. 6 Illustrates the potential for surviving numbers with an emphasis on a sample of numbers eight (8), nine (9), ten (10), eleven (11) & twelve (12) that fall inbetween the two winning numbers Seven & Thirteen.

FIG. 6 illustrates a potential for surviving numbers. In this instance, the emphasis is upon an eight 24, nine 26, ten 28, eleven 30 and twelve 32, that, for the hand, all fall inbetween the two winning numbers seven 20 and thirteen 22.

Figure 7:
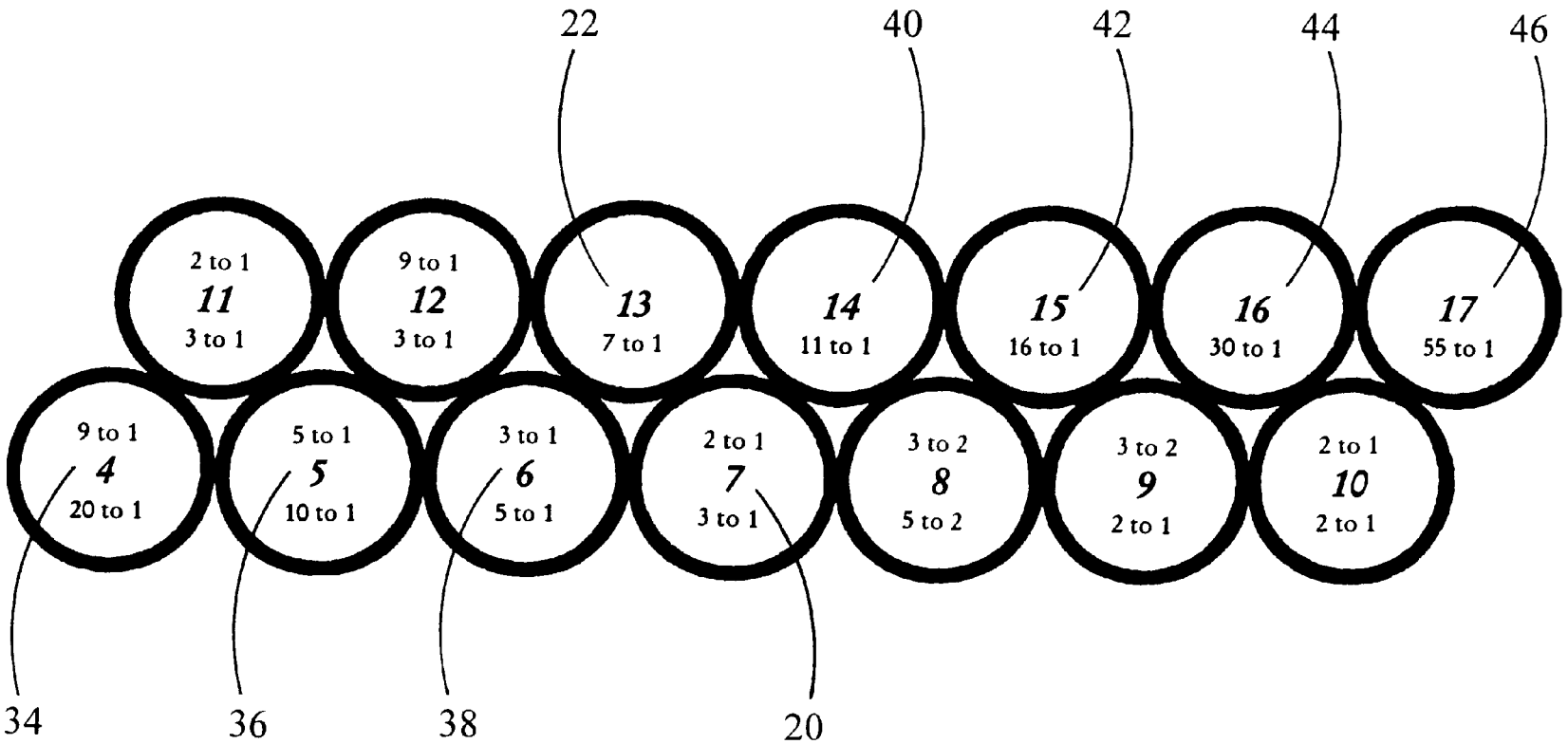
FIG. 7 Illustrates a sample of a completed hand's fallout numbers wherein the four (4), five (5) & six (6) fallout before the first winning number of Seven, while the fourteen (14), fifteen (15), sixteen (16) & seventeen (17) fallout after the second winning number Thirteen, in this case.

Conversely, FIG. 7 illustrates the fallout or wins for the house of numbers four 34, five 36 and six 38, which are numbers lying before a first dice event's roll of seven 20. While the second fallout group of numbers, or wins for the house are those numbers lying after a second winning number thirteen 22. These numbers are fourteen 40, fifteen 42, sixteen 44 and seventeen 46, respectively.

Figure 8:
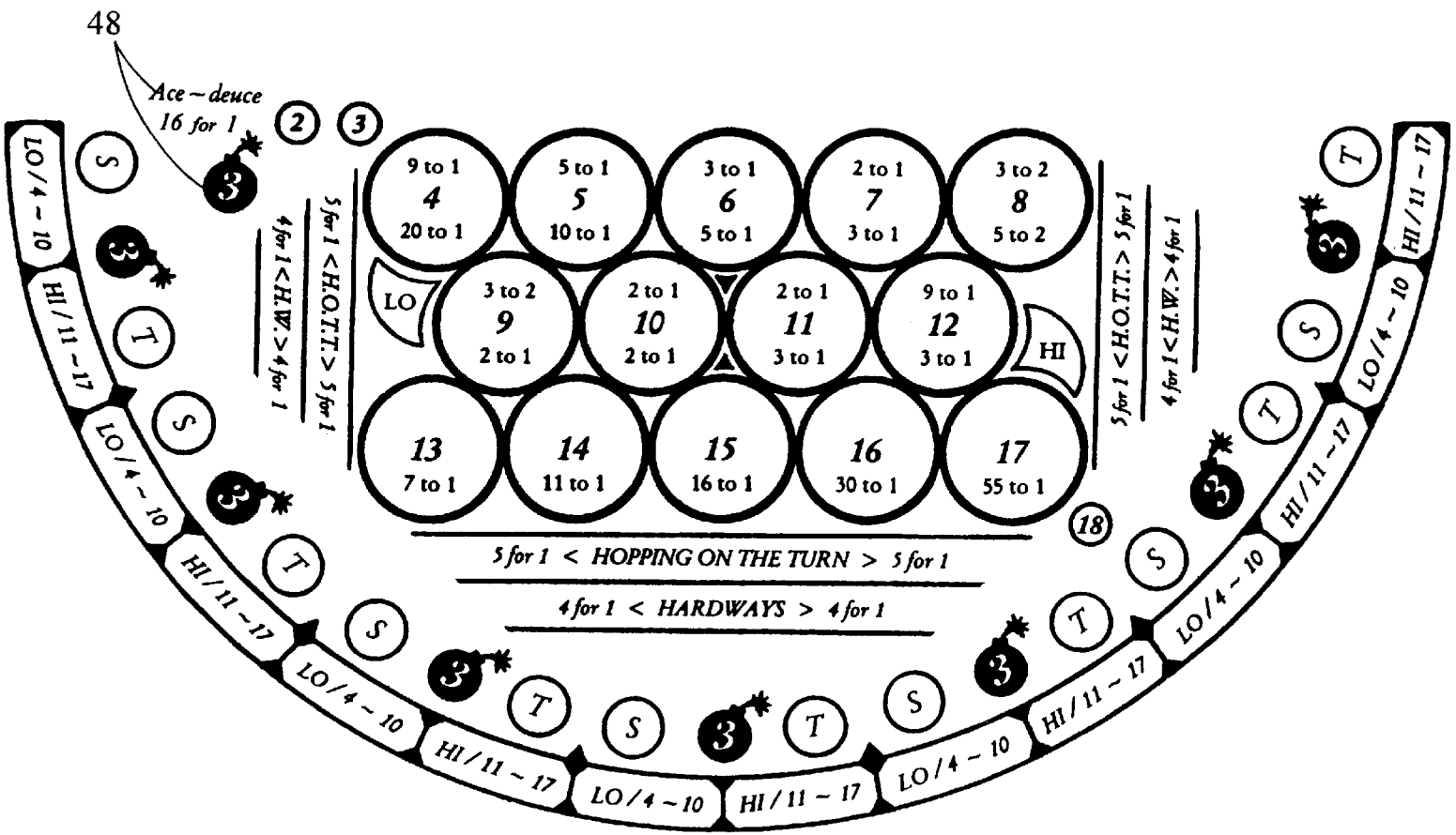
FIG. 8 Illustrates the wagering position of an Ace-Deuce insurance option.

FIG. 8 illustrates a placement location for an ace-deuce three 48 wager. As such, this insurance wager's probabilities are factored in for both its own sake as a proposition wager, as well as accounting for its impact as an ameliorating "wipe out" roll against all other wagering opportunities offered across the table. Upon the showing of an ace-deuce three 48, all Field number wager(s) and most ancillary wager(s) fall as wins for the house.

Figure 9:
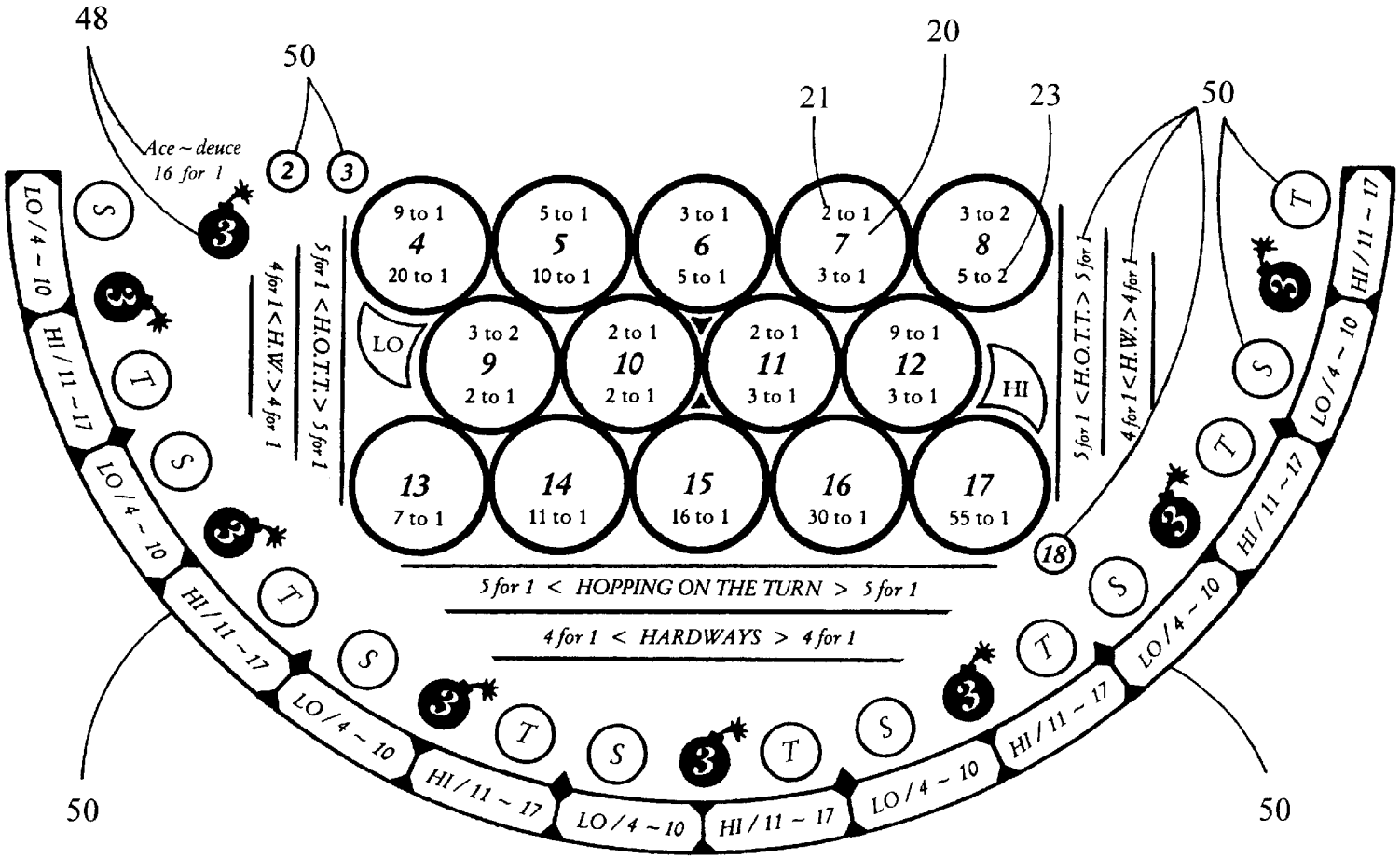
FIG. 9 Illustrates a plan view of a preferred embodiment for the Field number wagers along with additional ancillary wagering options being offered.

Finally, FIG. 9 illustrates a preferred variety of wagering options for the applicants' game, including a plethora of ancillary wagers 50 being offered to players on this exemplary layout's configuration, but not being explicitly discussed or claimed individually.

Figure 10:
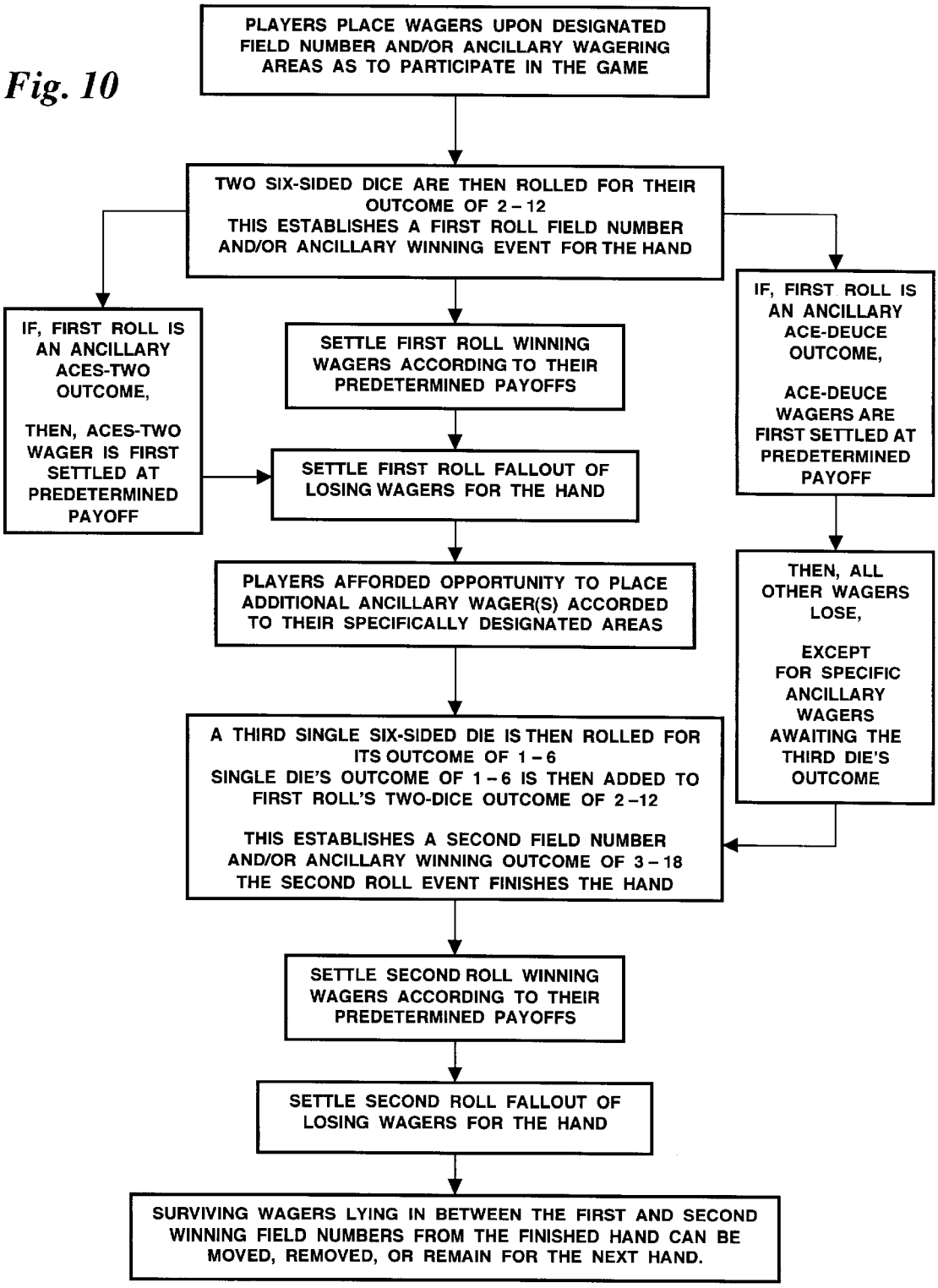
FIG. 10 illustrates the flow of progressive events for completing a hand.

FIG. 10 illustrates a specific progression of events from start-to-finish of play.

OPERATIONAL ADVANTAGES

As aforementioned, the applicants' methodologies in most all instances produce two (2) winning dice events per hand instead of just one (1). While simultaneously supplying a significantly lower exposure to the vigorish of a simple three-dice game. Moreover, these methodologies uniquely allow for up-to-five (5) surviving Field number(s) lying inbetween any two (2) winning numbers, except for the occasions of either an ace-deuce (3), three aces (3) or any sequentially winning numbers, such as 7 & 8; 8 & 9 etc., having completed a hand's play upon the dice. Likewise, the number and types of ancillary wagers being associated to the core field betting activities of the game will vary according to table size alone.

Furthermore, it is the position of the applicants, that the methods being cited and claimed below bare in their effects, the casting away of long held notions that the mathematical nature of a three-dice game is way too "heavy for today's public consumption."

Most notably, the applicants' three-dice process of play provides for a key unexpected benefit for both players and Casinos alike. Wherefore, a credible balance between the Casino's necessary vigorish and a player's exposure to it is definitely made much more palatable. This is directly due to the ameliorating synergistic dynamics of splitting a hand's roll as described and illustrated, therein producing a ready potential for an additional lot of surviving Field number wager(s) being carried through from hand-to-hand.

As for the gaming industry, Casinos can once again offer their customers an exciting option to Bank Craps that is simple to grasp and will not be so immediately hazardous to their "Time-In-Play." Accordingly, the present invention has been described with respect to specific methods and embodiments. Likewise, it will be understood that various changes and modifications will be suggested by those skilled in the art. Therefore, it is the intent of the applicants to anticipate such changes and modifications as falling within the scope of the appended claims.

I claim:

1. A method for playing a dice game engaging the use of three six-sided dice with each face thereof, having sequentially numbered indicia thereon, being rolled at separate times having their mathematical summations added together for producing both winning and losing field numbers and ancillary wagers, comprising the steps of:

(a) affording each player an opportunity to place a number of field number wagers upon their designated wagering areas as to participate in said dice game;

(b) affording each player an opportunity to place a number of ancillary wagers upon their designated wagering areas;

(c) a player first selecting two of three dice, rolling the two-dice and summing together the indicia generated by said two-dice, for establishing a first roll winning number in the sum of two through twelve for a hand;

(d) settling the first roll winning wagers according to a predetermined payoff;

(e) settling a first falling out of losing wagers for said hand;

(f) affording each player the opportunity to place additional ancillary wagers upon their designated areas;

(g) said player rolling a third die producing a summation outcome of one through six;

(h) adding said third die's sum to the first two-dice sum for establishing a second roll winning number in the summation of three through eighteen, whereby completing said hand;

(i) settling the second roll winning wagers according to a predetermined payoff;

(j) settling a second falling out of losing wagers for said hand.

2. The method of claim 1, further includes said ancillary wagers of step (b) as summating at an aces two finish or summating at an ace-deuce three finish for producing one-of-two first roll ancillary outcome possibilities.

3. The method of claim 1, further including said predetermined payoffs for said first roll winning wagers of step (d) to substantially comprise:

| First Roll No's. | Payoffs |
|---|---|
| Ancillary Wagers: | |
| Two | 30 to 1 |
| Three | 15 to 1 |
| Field Wagers: | |
| Four | 9 to 1 |
| Five | 5 to 1 |
| Six | 3 to 1 |
| Seven | 2 to 1 |
| Eight | 3 to 2 |

-continued

| First Roll No's. | Payoffs |
|---|---|
| Nine | 3 to 2 |
| Ten | 2 to 1 |
| Eleven | 2 to 1 |
| Twelve | 9 to 1. |

4. The method of claim 1, further includes said first falling out of losing wagers for said hand of step (e) as all lying numerically before the first winning number of said hand.

5. The method of claim 1, further includes said additional ancillary wagers of step (f) as being made inbetween rolls.

6. The method of claim 1, further includes said second roll winning number of step (h) as being a three-aces three finish or a three-sixes eighteen finish, for producing one-of-two-more second roll ancillary outcome possibilities for said hand.

7. The method of claim 1, further including said predetermined payoffs for said second roll winning wagers of step (i) to substantially comprise:

| Second Roll No's. | Payoffs |
|---|---|
| Ancillary Wager: | |
| Three | 175 to 1 |
| Field Wagers: | |
| Four | 20 to 1 |
| Five | 10 to 1 |
| Six | 5 to 1 |
| Seven | 3 to 1 |
| Eight | 5 to 2 |
| Nine | 2 to 1 |
| Ten | 2 to 1 |
| Eleven | 3 to 1 |
| Twelve | 3 to 1 |
| Thirteen | 7 to 1 |
| Fourteen | 11 to 1 |
| Fifteen | 16 to 1 |
| Sixteen | 30 to 1 |
| Seventeen | 55 to 1 |
| Ancillary Wager: | |
| Eighteen | 175 to 1. |

8. The method of claim 1, further includes said second falling out of losing wagers for said hand of step (j) as all lying numerically after said second winning number for said hand.

9. A live action or electronic gaming process engaging the instrument of, or display of, three six-sided dice baring sequenced indicia thereon, having as a main consequence of play a number selection of two to eighteen, including a number of associated ancillary wagers, comprising the steps of:

(a) affording each player an option to place field number and ancillary wagers for participating in said gaming process;

(b) utilizing three dice in said gaming processes with each said six-sided die having sequentially numbered indicia thereon;

(c) splitting a hand's play into two separate dice events;

(d) engaging a two-dice means as a first roll event producing a sum of two through twelve for establishing a first winning number of said hand;

(e) settling the first winning number according to a predetermined payoff;

(f) having a first fall out of losing numbers lying numerically before said first winning number of said hand;

(g) engaging a third single die means as a second roll event producing an outcome of one through six;

(h) said third single die means producing said second roll event being added to the sum of said first roll event, for establishing a second winning number of said hand;

(i) settling the second winning number according to a predetermined payoff;

(j) having a second fall out of losing numbers lying numerically after said second winning number for said hand;

(k) having up to five surviving numbers lying inbetween the first and said second winning numbers;

(l) utilizing a first roll ace-deuce wager means option prior to a first two-dice roll of said hand for protecting other wagers from said first two-dice roll summation of an ace-deuce three outcome.

10. The process of claim 9, further includes said two-dice means of step (d) as summating in the ancillary outcomes of an aces two finish or an ace-deuce three finish for said first roll event.

11. A split-hand three dice gaming methodology producing a two-tier probability format, resulting in the mathematical advantage of a significantly lower working vigorish-percentage being held against its players, comprising:

a gaming process utilizing three six-sided dice each having a sequentially marked face one to six thereon;

said gaming process utilizing an applied technique of splitting a hand's play into two separate but coalescing rolls of said three six-sided dice providing a first roll event and a second roll event thereof, for said hand's play;

with, said hand's said first roll event and said second roll event engaging field number, ancillary and surviving field number wager possibilities for said three-dice gaming methodolgy;

a first roll event of a two-dice means producing a summation of two through twelve, establishing a first roll winning number outcome for supporting a first tier of a two-tier probability of chance payoff schedule;

a second roll event of a third single die means producing an outcome summation of one through six;

said third single die means being added together with the sum of said first roll of a two-dice means producing a final combined summation of up to eighteen, establishing a second roll winning number outcome for supporting a second tier of said two-tier probability of chance payoff schedule;

said split-hand three dice gaming methodology resulting in said two-tier probability of chance payoff schedules whereby significantly reducing the inherently strong mathematical consequences being traditionally associated with a three-dice gaming dynamic.

12. The methodology of claim 11 further includes a two-dice means, aces two outcome finish or a two-dice means, ace-deuce three outcome finish as said first roll events in support of said first tier of said two-tier probability of chance payoff schedule.

13. The methodology of claim 11 further includes possible surviving field number wagers lying inbetween said first roll winning number and said second roll winning number.

14. The methodology of claim 11 further includes a falling out of losing numbers lying before said first roll winning number.

15. The methodology of claim 11 further includes a falling out of losing numbers lying after said second roll winning number.

* * * * *